US006249758B1

(12) United States Patent
Mermelstein

(10) Patent No.: US 6,249,758 B1
(45) Date of Patent: Jun. 19, 2001

(54) APPARATUS AND METHOD FOR CODING SPEECH SIGNALS BY MAKING USE OF VOICE/UNVOICED CHARACTERISTICS OF THE SPEECH SIGNALS

(75) Inventor: Paul Mermelstein, Cote St. Luc (CA)

(73) Assignee: Nortel Networks Limited, Montreal (CA)

( * ) Notice: Subject to any disclaimer, the term of this patent is extended or adjusted under 35 U.S.C. 154(b) by 0 days.

(21) Appl. No.: 09/107,385

(22) Filed: Jun. 30, 1998

(51) Int. Cl.[7] ..... G10L 19/00
(52) U.S. Cl. ..... 704/220; 704/225; 704/214
(58) Field of Search ..... 704/206, 214, 704/220, 226, 221, 225, 219, 258, 268

(56) References Cited

U.S. PATENT DOCUMENTS

| | | | | |
|---|---|---|---|---|
| 5,717,824 | * | 2/1998 | Chhatwal | 704/222 |
| 5,734,789 | * | 3/1998 | Swaminathan et al. | 704/206 |
| 5,751,903 | * | 5/1998 | Swaminathan et al. | 704/230 |
| 5,806,038 | * | 9/1998 | Huang et al. | 704/268 |
| 5,864,798 | * | 1/1999 | Miseki et al. | 704/225 |
| 5,995,923 | * | 11/1999 | Mermelstein et al. | 704/219 |
| 6,003,001 | * | 12/1999 | Maeda | 704/223 |
| 6,041,297 | * | 3/2000 | Goldberg | 704/219 |
| 6,058,359 | * | 5/2000 | Hagen et al. | 704/214 |
| 6,073,092 | * | 6/2000 | Kwon | 704/219 |

OTHER PUBLICATIONS

"Code–Excited Linear Prediction (CELP): High Quality Speech at Very Low Bit Rates", Proceedings of ICASSP, pp. 937–940, 1985.

International Telecommunication Union Telecommunications Standardization Sector (ITU–TSS) Draft recommentation G.729 Coding of speech at 8 kbits/s using Conjugate–Structure, Jun. 8, 1995.

* cited by examiner

*Primary Examiner*—William R. Korzuch
*Assistant Examiner*—Susan Wieland

(57) ABSTRACT

An audio signal encoding device is provided comprising an input for receiving a sub-frame of an audio signal, a voiced audio signal synthesis stage, an unvoiced audio signal synthesis stage, and a processing unit. The voiced audio signal synthesis stage is operative for producing a first synthetic audio signal approximating the sub-frame of an audio signal received at the input on the basis of a first set of parameters. The unvoiced audio signal synthesis stage is operative for producing a second synthetic audio signal approximating the sub-frame of an audio signal received at the input on the basis of a second set of parameters. The processing unit is operative for releasing a set of parameters allowing to generate a selected one of the first synthetic audio signal and the second synthetic audio signal.

36 Claims, 6 Drawing Sheets

APPARATUS AND METHOD FOR CODING SPEECH SIGNALS BY MAKING USE OF VOICE/UNVOICED CHARACTERISTICS OF THE SPEECH SIGNALS

FIELD OF THE INVENTION

This invention relates to the field of processing audio signals, such as speech signals that are compressed or encoded with a digital signal processing technique. More specifically, the invention relates to an improved method and an apparatus for coding speech signals that can be particularly useful in the field of wireless communications.

BACKGROUND OF THE INVENTION

In communication applications where channel bandwidth is at a premium, it is essential to use the smallest possible portion of a transmission channel in order to transmit a voice signal. A common solution is to process the voice signal with an apparatus called a speech codec before it is transmitted on a RF channel.

Speech codecs, including an encoding and a decoding stage, are used to compress (and decompress) the digital signals at the source and reception point, respectively, in order to optimize the use of transmission channels. By encoding only the necessary characteristics of a speech signal, fewer bits need to be transmitted than what is required to reproduce the original waveform in a manner that will not significantly degrade the speech quality. With fewer bits required, lower bit rate transmission can be achieved Most state-of-the-art codecs are based on the original CELP odel proposed by Schroeder and Atal in "Code-Excited Linear Prediction (CELP): High Quality Speech at Very Low Bit Rates," Proceedings of ICASSP, pp. 937–940, 1985. This document is hereby incorporated by reference. This basic codec model has been improved in many aspects to achieve bit rates of approximately 8 kbits/sec and even lower, but voice quality in those with lower bit rates may not be acceptable for telephony applications. An example of an 8 kbits/sec codec is fully described in version 5.0 of the International Telecommunication Union Telecommunications Standardization Sector (ITU-TSS) Draft recommendation G.729 "Coding of speech at 8 kbits/s using Conjugate-Structure Algebraic-Code-Excited Linear-Predictive (CS-ACELP) coding", dated Jun. 8, 1995. This document is hereby incorporated by reference.

Considering that lower bit rates at acceptable speech quality provide great economical advantages, there exists a need in the industry to provide, an improved speech coding apparatus and method particularly well suited for telecommunications applications

OBJECTIVES AND SUMMARY OF THE INVENTION

A general object of the invention is to provide an improved audio signal coding device, such as a Linear Predictive (LP) encoder, that achieves audio coding at low bit rates while maintaining audio quality at a level acceptable for communication applications.

A more specific object of the invention is to provide an audio signal coding device and a method for coding audio signals while taking into consideration the voiced or unvoiced nature of the audio signal.

Another specific object of the invention is to provide an audio signal coding device and a method for coding an audio signal capable of better predicting the pitch characteristics of the audio signal.

Another specific object of the invention is to provide an audio signal coding method for smoothing the parameters for voiced and unvoiced subframes before their transmission.

In this specification, the term "filter coefficients" is intended to refer to any set of coefficients that uniquely defines a filter function that models the spectral characteristics of an audio signal. In conventional audio signal encoders, several different types of coefficients are known, including linear prediction coefficients, reflection coefficients, arcsines of the reflection coefficients, line spectrum pairs, log area ratios, among others. These different types of coefficients are usually related by mathematical transformations and have different properties that suit them to different applications. Thus, the term "filter coefficients" is intended to encompass any of these types of coefficients.

In this specification, the term "excitation segment" is defined as information that needs to be combined with the filter coefficients in order to provide a complete representation of the audio signal. Such excitation segment may include parametric information describing the periodicity of the speech signal, a residual (often referred to as "excitation signal") as computed by the encoder of a vocoder, speech framing control information to ensure synchronous framing in the decoder associated with the remote vocoder, pitch periods, pitch lags, gains and relative gains, among others.

In this specification, the term "sample" refers to the amplitude value at one specific instant in time of a signal. PCM (Pulse Code Modulation) is a form of coding of an analog signal that produces plurality of samples, each sample representing the amplitude of the waveform at a certain time.

The term "audio signal subframe" refers to a set of samples that represent a portion of an audio signal such as speech. For example, in an embodiment of this invention, subframes of 40 samples were used. Also, "audio signal frames" are defined as a plurality of samples sets, each set being representative of a sub-frame. In a specific example, an audio signal frame has four sub-frames In a most preferred embodiment, the audio signal-encoding device encodes an audio signal, such as a speech signal differently in dependence upon the voiced/unvoiced characteristics of the signal. In a most preferred embodiment, the audio signal encoding device includes two signal synthesis stages, one better suited for unvoiced signals and one better suited for voiced signals. In operation, each signal synthesis stage generates a synthesized speech signal based on a set of parameters, such as filter coefficients and excitation segment computed to best approximate the input speech signal sub-frame. The two synthesized signals are compared and the one that manifests less error with respect to the input speech signal is selected as being the best match and the parameters previously computed for this synthesized signal are the ones used to form the compressed or encoded audio signal sub-frame.

The major difference between the signals produced by the voiced signal synthesis stage and the unvoiced signal synthesis stage reside in the periodicity or pitch of the signals. The synthesized voiced signal manifests a higher periodicity than the synthesized unvoiced signal.

In a specific example, the voiced signal synthesis stage comprises an adaptive codebook containing prior knowledge entries that are past audio signal sub-frames. The output of this codebook provides the periodic component of the signal generated by the voiced signal synthesis stage. Selecting an entry from a pulse stochastic codebook and passing this entry into a synthesis filter produces the aperiodic component.

The unvoiced signal synthesis stage comprises a noise stochastic codebook that issues a sample noise signal used as input to a synthesis filter. The output of the synthesis filter is the synthetic unvoiced audio signal.

As embodied and broadly described herein, the invention provides an audio signal encoding device comprising:

an input for receiving a sub-frame of an audio signal;

a voiced audio signal synthesis stage coupled to said input capable of producing a first synthetic audio signal approximating the sub-frame of an audio signal received at said input on a basis of a first set of parameters;

an unvoiced audio signal synthesis stage coupled to said input capable of producing a second synthetic audio signal approximating the subframe of an audio signal received at said input on a basis of a second set of parameters;

processing means coupled to said signal synthesis stages for outputting a set of parameters allowing generation of a selected one of the first synthetic audio signal and the second synthetic audio signal.

a)

As embodied and broadly described herein, the invention thus provides a method for encoding an audio signal comprising the steps of:

receiving a sub-frame of an audio signal;

producing a voiced synthetic audio signal approximating the sub-frame of an audio signal on a basis of a first set of parameters;

producing an unvoiced synthetic audio signal approximating the sub-frame of an audio signal on a basis of a second set of parameters;

processing said voiced synthetic audio signal and said unvoiced synthetic audio signal for generating a set of parameters allowing generation of a selected one of the voiced synthetic audio signal and the unvoiced synthetic audio signal.

As embodied and broadly described herein, the invention provides a computer readable storage medium containing a program element implementing functional blocks of an audio signal encoding device, the functional blocks comprising;

an input for receiving a sub-frame of an audio signal;

a voiced audio signal synthesis stage coupled to said input capable of producing a first synthetic audio signal approximating the sub-frame of an audio signal received at said input on a basis of a first set of parameters;

an unvoiced audio signal synthesis stage coupled to said input capable of producing a second synthetic audio signal approximating the subframe of an audio signal received at said input on a basis of a second set of parameters;

processing means coupled to said signal synthesis stages for outputting a set of parameters allowing generation of a selected one of the first synthetic audio signal and the second synthetic audio signal.

As embodied and broadly described herein the invention also provides an audio signal encoding device comprising:

an input for receiving a sub-frame of an audio signal to be encoded;

a codebook in which is stored at least one prior knowledge entries, said prior knowledge entry including a data element representative of characteristics of at least a portion of prior audio signal sub-frame;

processing means in operative relationship with said input and with codebook for generating a set of parameters allowing synthesization of the audio signal sub-frame, on a basis of at least:

(a) the sub-frame of an audio signal received at said input;

(b) the data element in said codebook.

As embodied and broadly described herein, the invention also provides an audio signal decoding device for synthesising a certain audio signal sub-frame from a set of parameters derived from an original audio signal sub-frame, said audio signal decoding device comprising:

an input for receiving the set of parameters derived from the original audio signal sub-frame;

a codebook in which is stored at least one prior knowledge entry, said prior knowledge entry including a data element representative of characteristics of at least a portion of a prior audio signal sub-frame synthesised by said audio signal decoding device prior the synthesization of the certain audio signal sub-frame processing means in operative relationship with said input and with codebook for synthesising the certain audio signal sub-frame on a basis of at least:

(a) the set of parameters received at said input;

(b) the data element in said codebook.

As embodied and broadly described herein, the invention also provides a method for synthesising a certain audio signal subframe from a set of parameters derived from an original audio signal sub-frame, said method comprising the steps of:

receiving the set of parameters derived from the original audio signal sub-frame;

providing a codebook in which is stored at least one prior knowledge entry, said prior knowledge entry including a data element representative of characteristics of at least a portion of a prior audio signal sub-frame synthesised by said audio signal decoding device prior the synthesization of the certain audio signal sub-frame synthesising the certain audio signal sub-frame on a basis of at least:

(a) the set of parameters received at said input;

(b) the data element in said codebook.

As embodied and broadly described herein, the invention also provides an apparatus for smoothing audio signal sub-frames, said apparatus comprising:

an input for receiving successive audio signal sub-frames;

processing means for (a) declaring each sub-frame either one of voiced and unvoiced;

(b) smoothing the voiced sub-frames separately from the unvoiced sub-frames.

DESCRIPTION OF A PREFERRED EMBODIMENT

Figure 1:
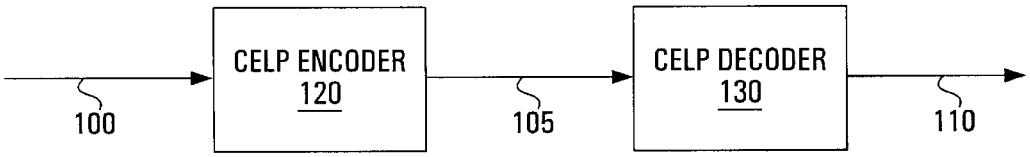
FIG. 1 PRIOR ART
FIG. 1 is a block diagram illustrating the concept of audio signal encoding and decoding process that takes place in a telecommunication system or any other environment where audio signals in encoded or compressed form are being transmitted.

A prior art speech encoder/decoder combination is depicted in FIG. 1. A PCM (Pulse Coded Modulation) speech signal 100 is input to a CELP (Code Excited Linear Prediction) encoder 120 that processes the audio signal provided and produces a representation of the signal in a compressed form. A single sub-frame of this signal in encoded form is represented by a set of parameters comprising filter coefficients and an excitation segment. The signal sub-frame is transported over a communication channel 105, which carries it to a CELP decoder 130. The signal sub-frame is processed by the decoder 130 that uses the filter coefficients and the excitation segment to synthesize the audio signal.

CELP encoders are the most common type of encoders used in telephony presently. CELP encoders send index information that points to a set of vectors in adaptive and stochastic codebooks. That is, for each speech signal sub-frame, the encoder searches through its codebook(s) for the one that gives the best perceptual match to the speech input when used as an excitation to the LPC synthesis filter.

Figure 2:
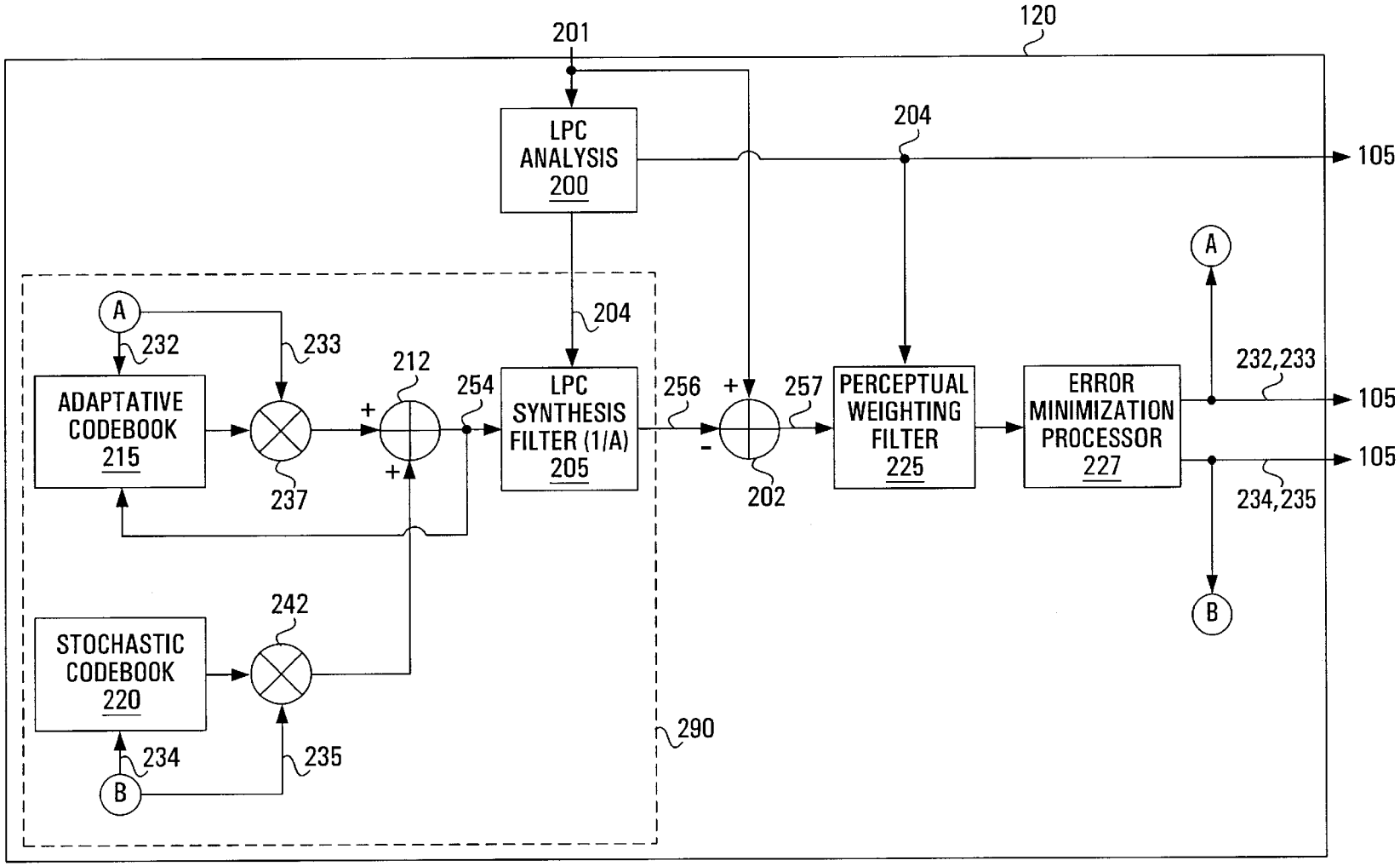
FIG. 2 PRIOR ART
FIG. 2 is a block diagram showing a prior art audio signal encoder.

FIG. 2 is a block diagram of a prior art CELP encoder. It can he noted that in this version of encoder 120 is provided an arrangement of sub-components that are an exact replica of a speech decoder, such as 130, that could be used to return the compressed speech to the PCM form. Box 290 illustrates these sub-components.

The encoder has an input that receives successive sub-frames of the PCM audio signal, such as speech signal 201. A signal sub-frame is input to an LPC analysis block 200 and to the adder 202. The LPC analysis block 200 outputs the LPC filter coefficients 204 for this sub-frame for transmission on the communication channel 105, as an input to an LPC synthesis filter 205, and as an input to a perceptual weighting filter 225. At the adder 202, the output 256 of the LPC synthesis filter 205 is subtracted from the PCM speech signal 201 to produce an error signal 257. The error signal 257 is sent to a perceptual weighting filter 225 followed by an error minimization processor 227 that outputs the pitch gain value 234, the lag value 232, the codebook index 233, and the stochastic gain value 235 that are transmitted over the communication channel 105.

The error minimization processor 227 compares the error signal output from the perceptual weighting filter 225 and, when the smallest error signal is achieved for a speech subframe, it signals the encoder 120 to send the compressed speech data for this speech subframe on communication channel 105. In this example, the compressed speech data includes the filter coefficients 204, the pitch gain value 233, the lag value 232, the codebook index 235, and the stochastic gain value 234. In order to achieve the smallest error for a speech subframe, the error minimization processor 227 sequentially generates new pitch gain and lag values and stochastic codebook indexes. Those new values are processed through a feedback loop to produce a new synthetic audio signal sub-frame that is again compared to the actual signal 201 sub-frame. When a minimal error is reached the filter coefficients and the excitation subframe computed to produce such minimal error are released for transport over the communication channel 105.

More specifically, the lag value 232 is also sent back to the adaptive codebook 215 to effect a backward adaptation procedure, and thus select the best waveform from the adaptive codebook 215 to match the input speech signal 201. The adaptive codebook 215 outputs the periodic component of the speech signal to the multiplier 237 where multiplication with the pitch gain 233 is effected and whose output is sent to the adder 212

The code index 234 for its part is also fed back to the stochastic codebook 220. The stochastic codebook 220 outputs the aperiodic component of the speech signal to the multiplier 242 where multiplication with the stochastic gain 235 is effected and whose output is sent to the adder 212.

At adder 212, the output of the multiplier 237 is added to the output of the multiplier 242 to form the complete excitation 254. The excitation 254 is fed back to the adaptive codebook 215 so that it may update its entries. The excitation 254 is also filtered by the LPC synthesis filter 205 to produce a reconstructed speech signal 256. The reconstructed speech signal 256 is fed to the adder 202.

The representation of the transfer function of a CELP codec as described in FIG. 2 is given by:

$$i(n)=[g_p a(n-L)+g_p b(n)]\otimes h_i(n)+e(n)$$

where i(n), n=1, . . . , N is the input sequence to be approximated;

a(n−L) is the ACB sequence selected;

$g_p$ is the pitch gain parameter adjusted to maximize the pitch prediction gain;

b(n) is a sparse impulse sequence (unit energy) taken from the SCB;

$gg_{pl}$ is a pulse gain parameter;

$h_i(n)$ is the impulse response of an all-pole LPC synthesis filter derived from the input signal;

e(n) is an error sequence to be minimized (after perceptual weighting); and

⊗ represents discrete convolution.

Figure 3:
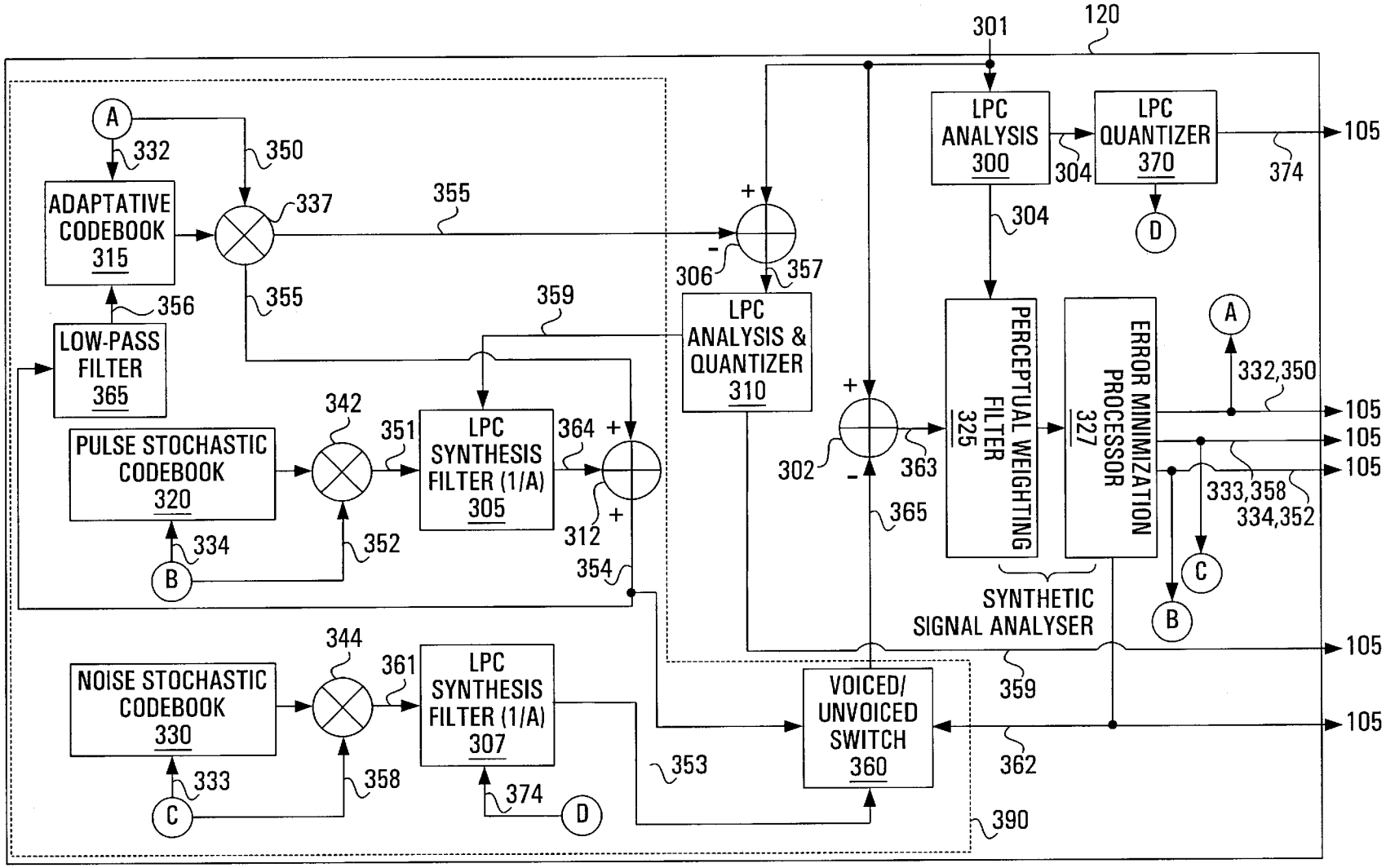
FIG. 3 is a block diagram of an audio signal encoder constructed in accordance with the present invention.

FIG. 3 provides a block diagram of an audio signal encoder in accordance with an embodiment of the invention. It can be noted that in this version of encoder 120 is provided an arrangement of sub-component that are an exact replica of a speech decoder, such as 130, that could be used to return the compressed speech to the PCM form. Box 390 illustrates these sub-components.

The only input to encoder 120 is the original PCM speech signal 301 sub-frame. In this embodiment of the invention, the outputs forming the compressed speech data when the speech subframe is voiced are different from when it is unvoiced. When it is determined that the speech signal is voiced, the compressed speech data includes a first set of parameters, comprising the filter coefficients 359, the pitch gain value 350, the lag value 332, the pulse codebook index 334, the pulse gain value 352, and the voiced/unvoiced control signal 362. When the speech signal is unvoiced, the compressed speech data includes a second set of parameters, comprising the filter coefficients 304, the noise codebook index 333, the noise gain value 358, and the voiced/unvoiced control signal 362.

Three codebooks are provided in the encoder 120; namely, the adaptive codebook 315, the pulse stochastic codebook 320 and the noise stochastic codebook 330. The decoder 130 must possess codebooks having the same entries as those in the encoder 120 codebooks in order to produce speech of good quality. The parameters 332, 333, 334, 350, 352, and 358 selected by the error minimization processor 327 are also fed back as control signals to codebooks 315, 320 and 330 and to gain multipliers 337, 342, and 344. The control values to the three codebooks 315, 320 and 330 and to the three gain multipliers 337, 342 and 344 are determined from an sequential process that chooses the smallest weighted error 363 between the reconstructed speech signal 365 and the original speech signal 301.

The adaptive codebook 315 is a memory space that stores at least one data element representative of the characteristics of at least a portion of a past audio signal subframe. In a specific example, the codebook 315 stores a sequence of past reconstructed speech samples of a length sufficient to include a delay corresponding to the maximum pitch lag. The number of past reconstructed speech samples may vary, but for speech sampled at 8 kHz, a codebook containing 140 samples (this is equivalent to 3–5 past reconstructed or synthesized audio signal sub-frames) is generally sufficient. In this example, each data element is associated with a past-reconstructed audio signal subframe. In other words, each data element covers 40 samples. The codebook 315 may be in a buffer format that simply uses the pitch lag 332 applied to an input of the codebook as a pointer to the start of the subframe to be extracted and that appears at an output of the codebook.

The adaptive codebook 315 is updated with input 356 that is a representation of the reconstructed speech signal 354 after it has been low-pass filtered by the low-pass filter 365. The function of the low-pass filter 365 is to attenuate the high-frequency component which manifests weaker periodicity. Input 356 is stored as the last 40 sample data element in the adaptive codebook's table 315. The oldest table 40 sample data element of the adaptive codebook 315 is deleted concurrently.

The pulse stochastic codebook 320 and the noise stochastic codebook 330 are used to derive the aperiodic component of the reconstructed speech signal 365. Both these codebooks 320 and 330 are memory devices that are fixed in time. The pulse stochastic codebook 320 stores a certain number of separately generated pulse-like entries (i.e., few non-zero pulses) The pulse-like entries may also be called "vectors". The number of entries may vary, but in an embodiment of this invention, a pulse stochastic codebook 320 containing 512 entries has been used and works well. In this embodiment, 40 of the entries are vectors comprising only one non-zero value (i.e., one pulse), and the remaining 472 entries are vectors comprising two pulses of equal magnitude and opposite sign. The codebook vectors actually used are selected from the list of all possible such vectors by a codebook training process. The process eliminates the least frequently used vectors when coding a training set of several spoken sentences. The codebook 320 may be in a table format that simply uses the pulse codebook index 334 as a pointer to one of the vectors to be used. Upon receiving the code index 334, the pulse stochastic codebook 320 outputs the chosen table entry to multiplier 342.

The noise stochastic codebook 330 stores a certain number of noise-like entries. The noise-like entries are derived from a gaussian distribution. The noise-like vectors, which are entries to the noise stochastic codebook, are populated by outputs from a pseudo-random gaussian noise generator whose variance is adjusted to provide unit vector energy. The number of vectors may vary, but a noise stochastic codebook 330 containing as few as 16 entries has been used and works well. The codebook 330 may be in a table format that simply uses the noise codebook index 334 as a pointer to the noise vector to be used. Upon receiving the code index 333, the noise stochastic codebook 330 outputs the chosen table entry to multiplier 344.

Two LPC synthesis filters 305 and 307 are also provided in encoder 120. Both LPC synthesis filters 305 and 307 are the inverses of quantized versions of short-term linear prediction error filters (310 and 300 respectively) minimizing, in the case of 310, the energy of the prediction residual error 357 and, in the case of 300, the energy of the input residual error 301. LPC synthesis filters are well-known to those skilled in the art and will not be further described here.

A low-pass filter 365 is provided in encoder 120 for enhancing the correlation between the speech subframe under analysis and past-reconstructed speech subframes. In a preferred embodiment, the low-pass filter 365 is a five tap Finite Impulse Response (FIR) filter with attenuation specified at two frequencies. Suitable values for attenuation are as follows: 4 dB at 2 kHz, and 14 dB at 4 kHz. Low-pass FIR filters are well-known to those skilled in the art and will not be further described here.

The voiced/unvoiced switch 360 chooses the reconstructed speech signal 365 (354 or 353) that will be sent to the adder 302 of a synthetic signal analyser that also includes the perceptual weighting filter 325 and the error minimization processor 327 based upon the voiced/unvoiced control signal 362. Control signal 362 is output from the error minimization processor 327 and is based upon its calculation of which signal (354 or 353) will result in the smallest error 363 in representing the input speech signal 301. The least means square method may be used to calculate the smallest error 363. In effect, control signal 362 will instruct the voiced/unvoiced switch 360 to choose the reconstructed speech signal 354 when the input speech signal 301 is voiced or, on the other hand, choose the reconstructed speech signal 353 when the input speech signal 301 is unvoiced.

The perceptual weighting filter 325 is a linear filter that attenuates those frequencies where the error is perceptually less important and that amplifies those frequencies where the error is perceptually more important. Perceptual weighting filters are very well known to those skilled in the art and will not be further described here.

The error minimization processor 327 uses the error signal output from the perceptual weighting filter 325 and, when the sequential calculation of error signal is completed for a speech subframe, it signals the encoder 120 to send the compressed speech data producing the smallest error signal for the current speech subframe on communication channel 105. In order to achieve the smallest error for a speech subframe, the error minimization processor 327 comprises at least three sub-components; that is, a pitch gain and lag calculator, a pulse codebook index and gain calculator, and a noise codebook index and gain calculator. It is the values output by these calculators that the encoder 120 uses to produce different error signals 363 and to determine, from these, the smallest one.

The audio signal encoder illustrated in FIG. 3 and as described in detail above thus includes two voiced signal synthesis stages, namely a voiced signal synthesis stage that produces a first synthetic audio signal and an unvoiced signal synthesis stage that produces a second synthetic audio signal. The voiced audio signal synthesis stage includes the adaptive codebook 315, the pulse stochastic codebook 320 and the LPC synthesis filter 305 The set of samples that are output from the adaptive codebook 315 and that are multiplied by the gain at the gain multiplier 337 form the periodic component of the first synthetic audio signal. The aperiodic component of the first synthetic audio signal is obtained by passing the output of the pulse stochastic codebook 320 through the LPC synthesis filter 305 that receives the filter coefficients computed for the current sub-frame from the LPC analysis and quantizer block 310. The adder sums the periodic and the aperiodic components as output by the gain multiplier 355 and the LPC synthesis filter 305, respectively, to generate the first synthetic audio signal sub-frame The unvoiced signal synthesis stage includes the noise stochastic codebook 330 and the LPC synthesis filter 307. The latter receives the filter coefficients for the current subframe from the LPC analysis and quantizer block 310 and processes the output of the noise stochastic codebook 330 to generate the second synthetic audio signal sub-frame. The two synthetic audio signal sub-frames are then applied to the switch 360 that selects one of the signals and passes the signal to the synthetic signal analyzer.

An example of a basic sequential algorithm used to calculate the smallest value of the error signal follows. First, set the switch 360 to the voiced position such that the voiced synthetic signal will be applied to the synthetic signal analyser. Second, calculate the value of the error signal using a set of lag values 332 in the ACB 315 and the gain values in the multiplier 337 and storing the values of the error signal in a memory space. Prom the values of the error signal for the ACB 315 alone, chose the smallest one and, with the lag value 332 and gain value 350 used to obtain this result, calculate new error values using the index value 334 that are input to the pulse stochastic codebook 320 and the gain values that are input to the multiplier 342. If the error signal is sufficiently reduced, declare the subframe "voiced", leave the switch 360 to the voiced position, and send the various indices and values used to obtain the smallest error signal for this "voiced" subframe on the communication link 105. If, on the other hand, it is not possible to achieve a sufficiently small error signal using the pulse stochastic codebook 320, the subframe is declared "unvoiced", the switch 360 is set to the unvoiced position, and a third set of error values is calculated using the index values 333 that are input to the noise stochastic codebook 330 and the gain values 358 that are input to the multiplier 344, The various indices and values used to obtain the smallest error signal for this "unvoiced" subframe are sent on the communication link 105. The error minimization processor 327 also calculates the control signal 362, which was described earlier. Error minimization processors are very well-known to those skilled in the art and will not be further described here.

The following paragraphs describe the flow and evolution of the various signals in an encoder 120. An input speech signal 301 is first fed to the LPC analysis block 300, to adder 306 and to adder 302. The LPC analysis block 300 produces LPC filter coefficients 304 that are fed to the perceptual weighting filter 325 and to the LPC quantizer 370. The quantized versions of the filter coefficients 374 are fed to the LPC synthesis filter 307. The quantized LPC filter coefficients are also sent to the communication channel 105 upon calculation of the best parameters to represent the speech signal subframe being considered.

At adder 302, the error signal 363 is calculated as the result of the subtraction of the reconstructed speech signal 365 (354 or 353) from the input speech signal 301. This error signal 363 is fed to the perceptual weighting filter 325. Based on the LPC coefficients 304, the perceptual weighting filter 325 modifies the spectrum of the error signal for best masking of the current speech subframe before calculating the error energy. This modified error signal is forwarded to the error minimization processor 327 that calculates, through a closed-loop analysis, the compressed speech outputs that will best represent the input speech signal 301. When it is determined that the speech signal is voiced, the compressed speech data includes the quantized filter coefficients 359, the pitch gain value 350, the lag value 332, the pulse codebook index 334, the pulse gain value 352, and the voiced/unvoiced control signal 362. When it is determined that the speech signal is unvoiced, the compressed speech data includes the quantized filter coefficients 374, the noise codebook index 333, the noise gain value 358, and the voiced/unvoiced control signal 362. The error minimization processor 327 also calculates the control signal 362.

The lag value 332 is fed back to the adaptive codebook 315. It will act as a pointer to determine, from the adaptive codebook 315, the start of the speech subframe which will be chosen to output to multiplier 337. The pitch gain value 350 is fed back directly to multiplier 337. The multiplier 337 uses the pitch gain 350 and the output of the adaptive codebook 315 to produce a pitch prediction signal 355. The pitch prediction signal 355 is fed to adders 306 and 312.

At adder 306, the pitch prediction signal 355 is subtracted from the input speech signal 301 to produce the pitch prediction residual 357. Having removed the periodic component (i.e., the pitch prediction signal 355) from the input speech signal 301, what remains is an aperiodic signal (i.e., the pitch prediction residual 357). The pitch prediction residual 357 is fed to the LPC analysis and quantization block 310 (similar to block 300 discussed earlier) that produces LPC coefficients 359. These coefficients 359 are further fed to the LPC synthesis filter 305.

The pulse codebook index 334 is fed back to the pulse stochastic codebook 320. It will act as a pointer to determine, from the stochastic codebook 320, which pulse-like vector will be chosen to output to multiplier 342. The pulse gain value 352 is fed back directly to multiplier 342. The multiplier 342 uses the pulse gain and lag values 352 and the output of the pulse stochastic codebook 320 to produce an excitation signal 351. The excitation signal 351 is fed to the LPC synthesis filter 305. Along with LPC coefficients 359, the LPC synthesis filter 305 produces the aperiodic component 364 of a voiced speech signal. This aperiodic component 364 is added to the periodic component 355 to produce the reconstructed speech signal 354. The reconstructed speech signal 354 is returned to the adaptive codebook through a feedback loop and is also fed to the voiced/unvoiced switch 360.

The noise codebook index 333 is fed back to the noise stochastic codebook 330. It will act as a pointer to determine, from the noise stochastic codebook 330, which noise-like vector will be chosen to output to multiplier 344. The noise gain value 358 is fed back directly to multiplier 344. The multiplier 344 uses the noise gain and lag values 358 and the output of the noise stochastic codebook 330 to produce an excitation signal 361. The excitation signal 361 is fed to the LPC synthesis filter 307. With LPC coefficients 304, the LPC synthesis filter 307 produces a reconstructed speech signal 353. The reconstructed speech signal 353 is fed to the voiced/unvoiced switch 360.

The voiced/unvoiced switch 360 simply acts upon the input 362 that determines if the current speech subframe is voiced or unvoiced. If the subframe is voiced, switch 360 passes on signal 354 to adder 302, and if the subframe is unvoiced, signal 353 is passed on to adder 302. Both signals (353 and 354) are called signal 365 after switch 360.

The mathematical representation of a voiced speech signal for the novel CELP encoder described in FIG. 3 is given by:

$$i(n)=g_p a(n-L)\otimes h_f(n)+g_{pl} b(n)\otimes h_r(n)+e(n)$$

where i(n), n=1, . . . , N is the input sequence to be approximated;

a(n−Z) is the ACE sequence selected;

$h_f(n)$ is the impulse response of a fixed low-pass filter;

$g_p$ is the pitch gain parameter adjusted to maximize the pitch prediction gain;

b(n) is a sparse impulse sequence (unit energy) taken 10 from the SCB;

$h_r(n)$ is the impulse response of an all-pole LPC synthesis filter derived from the pitch residual;

$g_{pl}$ is a pulse gain parameter;

e(n) is an error sequence to be minimized (after perceptual weighting); and

⊗ represents discrete convolution.

The above description of the invention refers to the structure and operation of the encoder of the audio signal. In a practical system the encoding operation takes normally place at the source of the audio signal, such as in a telephone set. The audio signal in encoded or compressed form is transmitted to a remote location where it is decoded. In the encoded form the audio signal includes the filter coefficients and the excitation segment. At the remote location these two elements, namely the filter coefficients and the excitation Segment are processed by the decoder to generate a synthetic audio signal. The decoder has not been described in detail because its structure and operation are very similar to the audio signal encoder. With reference to FIG. 3, the structure of the audio signal decoder is identical to the components identified by the box 390 shown in dotted lines. The decoder receives for each sub-frame the filter coefficients and the excitation segment and issues a synthesized audio signal sub-frame. Note that each set of parameters for a given sub-frame carries an indication as to the nature of the set (either voice or unvoiced). The indication can be a single bit, the value 0 representing a set of parameters for an unvoiced signal while the value 1 represents a set of parameters for a voiced signal. This bit is used to set the voiced unvoiced switch to the proper position so the set of parameters can be transmitted to the proper synthesis stage.

Figure 4:
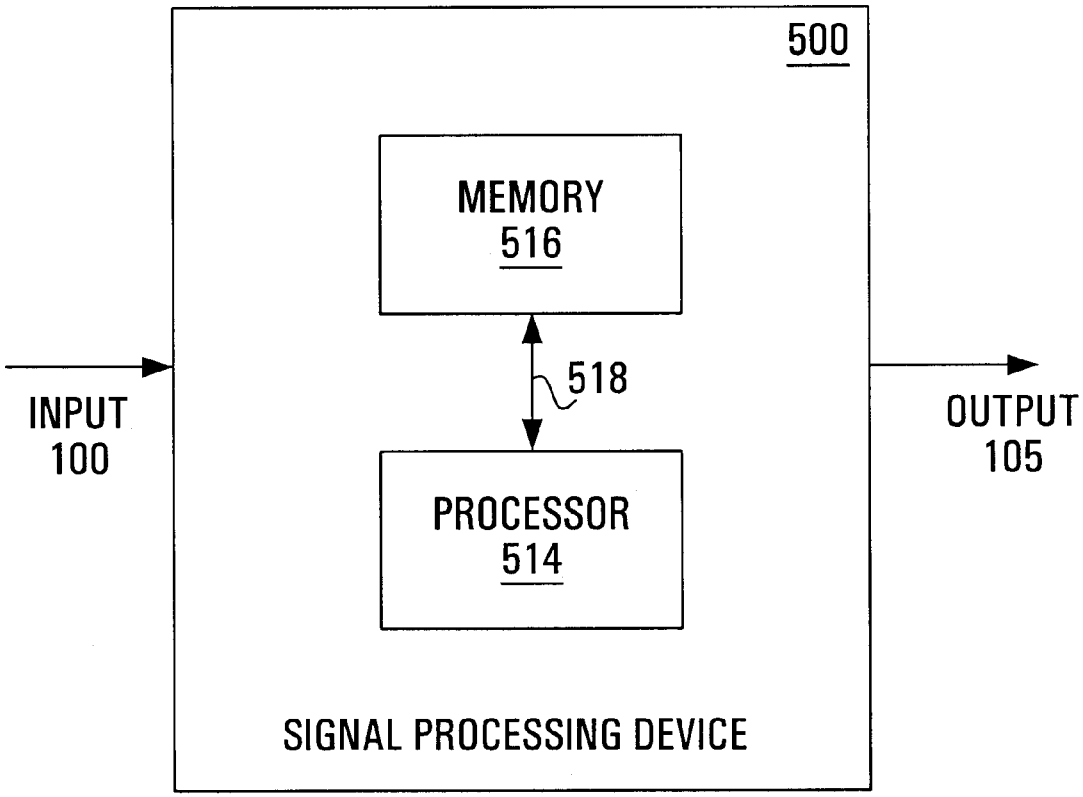
FIG. 4 is a block diagram of a signal processing device built in accordance with an embodiment of the invention and that can be used to implement the function of the encoder described in FIG. 3.

The apparatus illustrated at FIG. 4 can be used to implement the function of the encoder 120 whose operation is detailed above in connection with FIG. 3. The apparatus 500 comprises an input signal line 100, an output signal line 105, a processor 514 and a memory 516. The memory 516 is used for storing instructions for the operation of the processor 514 and also for storing the data used by the processor 514 in executing those instructions. A bus 518 is provided for the exchange of information between the memory 516 and the processor 514. The instructions stored in the memory 516 allow the apparatus to implement the functional blocks depicted in the diagram at FIG. 3. Those functional blocks can be viewed as individual program elements or modules that process the data at one of the inputs and issue processed data at the appropriate output.

Under this mode of construction, the encoder unit and the decoder units are actually program elements that are invoked when an encoding/decoding operation is to be performed. Other forms of implementation are possible. The encoder unit 120 may be formed by individual circuits, such as microcircuit hardwired on a chip.

In prior art audio signal vocoders, during speech processing operations, it is common practice to smooth out speech sample parameters across each speech frame. An example of a parameter that is smoothed is the amplitude of a speech sample. A frame typically comprises a small number of sub-frames, such as four sub-frames. A common smoothing method is to calculate the average slope for a given sub-frame of speech samples and to send averaged sample values, corresponding to the calculated slope, to the next speech processing operation. Tn fact, a more convenient method is to send only the slope and the period for which this slope is valid instead of the actual sample values.

An inherent problem in this smoothing operation is that it changes the "real" characteristics of a speech signal. This problem is exacerbated when, a given frame of speech samples includes voices and unvoiced sub-frames. The result is that the slope calculation discussed above is erroneous since the spectrum for voiced and unvoiced speech is quite different. In many cases this has no severe negative consequences since the resulting speech degradation is acceptable for a high bit rate. However, when encoding at low bit rates, the traditional smoothing method may significantly degrade the audio quality.

A novel method for smoothing parameters across speech frames is described below. This method has two different embodiments. In a first preferred embodiment, the speech sub-frames are classified as voiced or unvoiced. Classifying sub-frames into voiced and unvoiced categories is well known in the art to which this invention pertains. In a specific example, the voiced/unvoiced classification is based on information regarding the selected signal subframe including the relative subframe energy, the ACB gain, and the error reduction by means of the best entry from the pulse stochastic codebook. Once the speech subframes are identified as voiced or unvoiced a smoothing operation is performed by smoothing the voiced and unvoiced subframes separately within a frame. In other words, smoothing is applied to sub-frames within a given frame having the same classification. In a specific example, smoothing of the gain values and the LPC filter coefficients is performed. Smoothing algorithms are well known in the art to which this invention pertains and the smoothing of parameters other than the ones mentioned above does not detract from the spirit of the invention provided the smoothing is applied separately on voice and unvoiced speech sub-frames.

Figure 5:
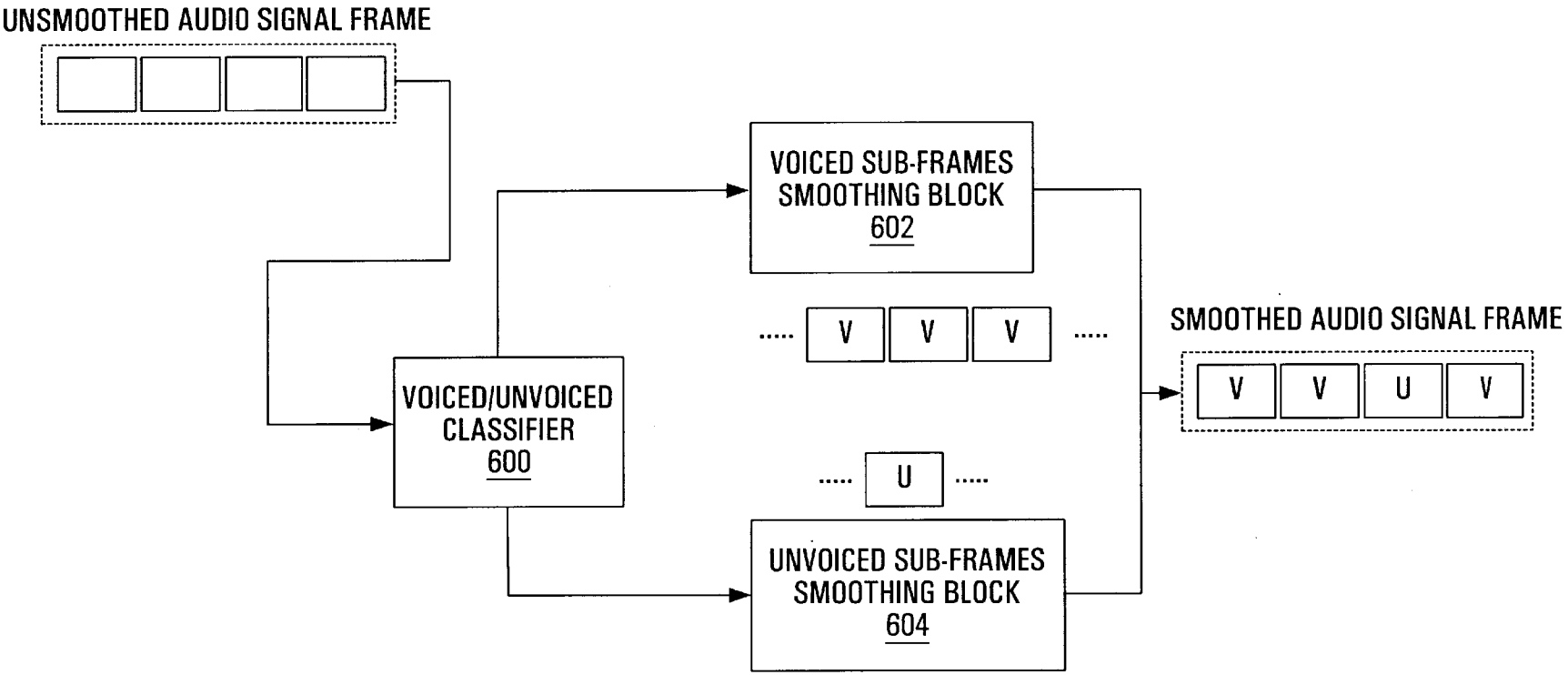
FIG. 5 is a block diagram of an apparatus for smoothing sub-frames according to an embodiment of the present invention.

An apparatus for smoothing audio signal frames in accordance with this embodiment is depicted in FIG. 5 At the input of the apparatus is supplied an audio signal frame to be processed. The frame has four sub-frames, there being three voiced sub-frames and one unvoiced sub-frame. A voiced/unvoiced classifier 600 processes individually the sub-frames individually according to determine if they fall in the voiced or unvoiced category by any one of the prior art methods mentioned earlier. The sub-frames that are declared as voiced are directed to a smoothing block 602 (that operates according to prior art methods), while the sub-frames that are declared unvoiced are directed to a smoothing block 604. Both smoothing blocks can be identical or use different algorithms. The smoothed sub-frames are then re-assembled in their original order to form the smoothed audio signal frame.

Figure 6:
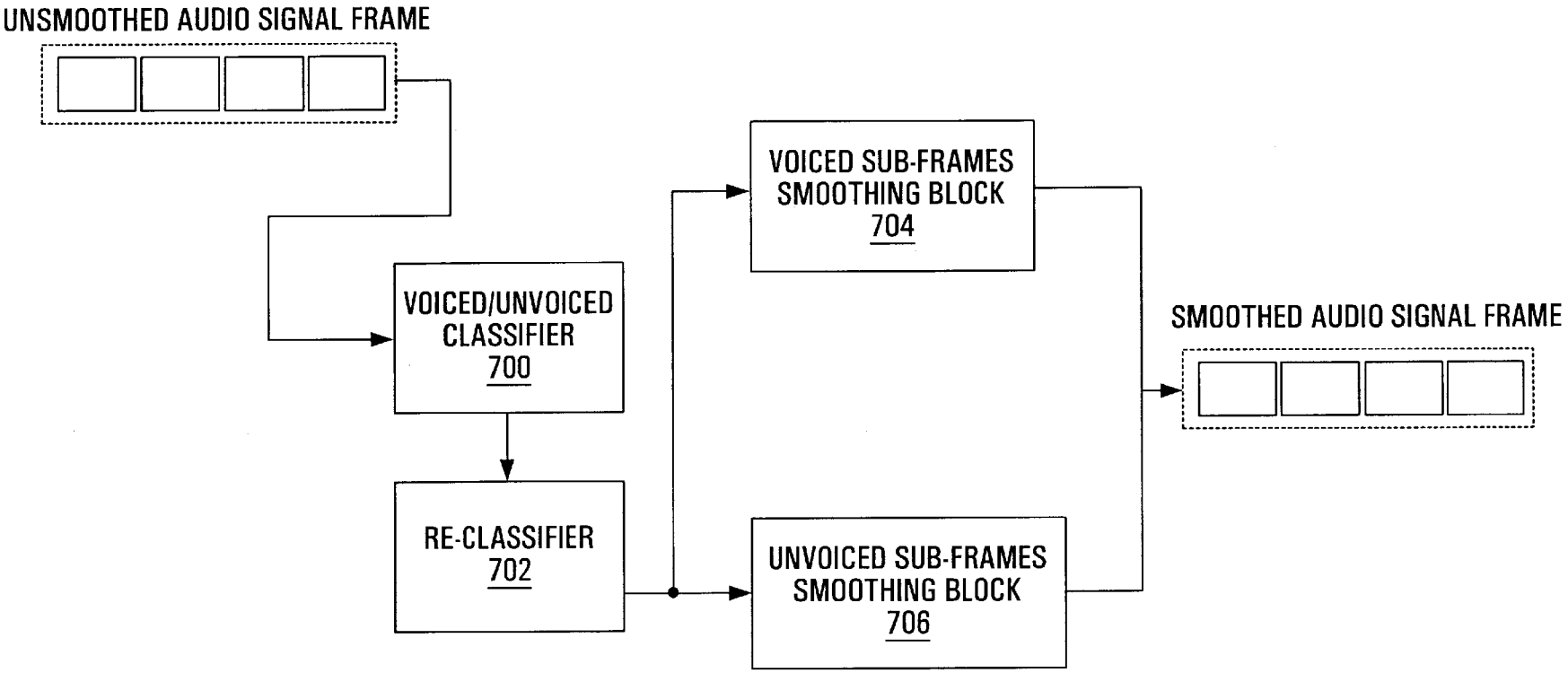
FIG. 6 is a block diagram of an apparatus for smoothing sub-frames in accordance to a variant.

In a second embodiment illustrated in FIG. 6, a unvoiced/voiced classifier examines each frame that arrives at its input. A re-classification block will change the class of a given sub-frame according to a selected heuristics model to a void multiple transitions voiced-unvoiced and vice-versa. The heuristics model may be such as to change the classification of a certain sub-frame when that sub-frame is surrounded by sub-frames of a different class. For example, the frame voiced|voiced|unvoiced|voiced, when processed by the reclassifier 702 will become voiced|voiced|voiced|voiced. Smoothing is then separately performed on the resulting sub-frames in a similar manner as described above. More specifically, isolated voiced or unvoiced sub-frames are reclassified so that only one voiced to unvoiced or unvoiced to voiced change is retained in any one frame.

The apparatus depicted in FIGS. 5 and 6 can be implemented on any suitable computing platform of the type illustrated in FIG. 4.

The above description of a preferred embodiment of the present invention should not be read in a limitative manner as refinements and variations are possible without departing from the spirit of the invention. The scope of the invention is defined in the appended claims and their equivalents.

I claim:

1. An audio signal encoding device comprising:

an input for receiving a sub-frame of an audio signal;

a voiced audio signal synthesis stage coupled to said input capable of producing a first synthetic audio signal approximating the sub-frame of an audio signal received at said input on a basis of a first set of parameters;

an unvoiced audio signal synthesis stage coupled to said input capable of producing a second synthetic audio signal approximating the sub-frame of an audio signal received at said input on a basis of a second set of parameters;

processing unit coupled to said signal synthesis stages for outputting a set of parameters allowing generation of a selected one of the first synthetic audio signal and the second synthetic audio signal, said processing unit comprising a switch having:

a) a first input coupled to said voiced audio signal synthesis stage for receiving the first synthetic audio signal;

b) a second input coupled to said unvoiced audio signal synthesis stage for receiving the second synthetic audio signal;

c) an output for releasing either one of the first synthetic audio signal and the second synthetic audio signal.

2. An audio signal encoding device as defined in claim 1, wherein said voiced audio signal synthesis stage comprises an adaptive codebook in which are stored a plurality of prior knowledge entries, each prior knowledge entry including a data element representative of characteristics of at least one prior sub-frame of an audio signal.

3. An audio signal encoding device as defined in claim 2, wherein said at least one prior subframe of an audio signal is a previously generated sub-frame of the first synthetic audio signal.

4. An audio signal encoding device as defined in claim 3, wherein each prior knowledge entry includes a set of samples from a previously generated sub-frame of the first synthetic audio signal.

5. An audio signal-encoding device as defined in claim 4, wherein each prior knowledge entry is a previously generated sub-frame of the first synthetic audio signal.

6. An audio signal encoding device as defined in claim 5, wherein said adaptive codebook includes:

an adaptive codebook input;

an adaptive codebook output, said adaptive codebook in response to receiving at said adaptive codebook input a parameter indicative of a selected one of the data elements in the codebook generating at said adaptive codebook output the samples associated with the previously generated sub-frame of the first synthetic audio signal corresponding to said selected one of the data elements.

7. An audio signal encoding device as defined in claim 6, wherein said voiced audio signal synthesis stage includes a gain multiplier coupled to said adaptive codebook output to multiply the samples associated with a previously generated sub-frame of the first synthetic audio signal generated at said adaptive codebook output by a certain gain value to form a periodic component of the first synthetic audio signal.

8. An audio signal encoding device as defined in claim 7, wherein said encoding device comprises a pulse stochastic codebook comprising a plurality of entries, each entry being representative of pulse-like signal.

9. An audio, signal-encoding device as defined in claim 8, wherein said signal encoding device includes a synthesis filter coupled to said pulse stochastic codebook to generate an aperiodic component of the first synthetic audio signal.

10. An audio signal encoding device as defined in claim 9, wherein said synthesis filter includes:

a first synthesis filter input for receiving a set of filter coefficients;

a second synthesis filter input coupled to said stochastic codebook for receiving a selected pulse-like signal output by said stochastic codebook, said synthesis filter processing the set of filter coefficients and the selected pulse-like signal output by said stochastic codebook to generate the aperiodic component of the first synthetic audio signal.

11. An audio signal encoding device as defined in claim 9, wherein said signal encoding device includes an adder receiving the aperiodic component and the periodic component of the first synthetic audio signal to add the aperiodic component and the periodic component of the first synthetic audio signal for generating the first synthetic audio signal.

12. An audio signal encoding device as defined in claim 1, wherein said encoding device comprises a noise stochastic codebook comprising a plurality of entries, each entry being representative of noise-like signal.

13. An audio signal encoding device as defined in claim 12, wherein said signal encoding device includes a synthesis filter coupled to said noise stochastic codebook.

14. An audio signal encoding device as defined in claim 13, wherein said synthesis filter includes:

first synthesis filter input for receiving a set of filter coefficients;

a second synthesis filter input coupled to said stochastic codebook for receiving a selected noise-like signal output by said noise stochastic codebook, said synthesis filter processing the set of filter coefficients and the selected noise-like signal output by said noise stochastic codebook to generate the second synthetic audio signal.

15. An audio signal encoding device as defined in claim 1, wherein said processing unit includes a synthetic signal analyzer coupled to the output of said switch for processing the synthetic audio signal produced at the output of said switch.

16. An audio signal encoding device as defined in claim 15, wherein said synthetic signal analyzer includes a perceptual weighing filter analyzer coupled to the output of said switch for selectively conditioning the synthetic audio signal produced at the output of said switch.

17. An audio signal encoding device comprising:

an input for receiving a sub-frame of an audio signal;

a voiced audio signal synthesis stage coupled to said input capable of producing a first synthetic audio signal approximating the sub-frame of an audio signal received at said input on a basis of a first set of parameters, said voiced audio signal synthesis stage comprising:

a) an adaptive codebook in which are stored a plurality of prior knowledge entries;

b) a gain multiplier coupled to said adaptive codebook operative to generate on the basis of the prior knowledge entries in the adaptive codebook a periodic component of the first synthetic audio signal;

an unvoiced audio signal synthesis stage coupled to said input capable of producing a second synthetic audio signal approximating the sub-frame of an audio signal received at said input on a basis of a second set of parameters;

a processing unit coupled to said signal synthesis stages for outputting a set of parameters allowing generation of a selected one of the first synthetic audio signal and the second synthetic audio signal.

18. An audio signal encoding device as defined in claim 17, wherein each prior knowledge entry includes a data element representative of characteristics of at least one prior sub-frame of an audio signal.

19. An audio signal encoding device as defined in claim 18, wherein said at least one prior subframe of an audio signal is a previously generated sub-frame of the first synthetic audio signal.

20. An audio signal encoding device as defined in claim 19, wherein each prior knowledge entry includes a set of samples from a previously generated sub-frame of the first synthetic audio signal.

21. An audio, signal-encoding device as defined in claim 20, wherein each prior knowledge entry is a previously generated sub-frame of the first synthetic audio signal.

22. An audio signal encoding device as defined in claim 21, wherein said adaptive codebook includes:

an adaptive codebook input;

an adaptive codebook output, said adaptive codebook in response to receiving at said adaptive codebook input a parameter indicative of a selected one of the data elements in the codebook generating at said adaptive codebook output the samples associated with the previously generated sub-frame of the first synthetic audio signal corresponding to said selected one of the data elements.

23. An audio signal encoding device as defined in claim 22, wherein said voiced audio signal synthesis stage includes a gain multiplier coupled to said adaptive codebook output to multiply the samples associated with a previously generated sub-frame of the first synthetic audio signal generated at said adaptive codebook output by a certain gain value to form a periodic component of the first synthetic audio signal.

24. An audio signal encoding device as defined in claim 23, wherein said encoding device comprises a pulse stochastic codebook comprising a plurality of entries, each entry being representative of pulse-like signal.

25. An audio signal-encoding device as defined in claim 24, wherein said signal encoding device includes a synthesis filter coupled to said pulse stochastic codebook to generate an aperiodic component of the first synthetic audio signal.

26. An audio signal encoding device as defined in claim 25, wherein said synthesis filter includes:

a first synthesis filter input for receiving a set of filter coefficients;

a second synthesis filter input coupled to said stochastic codebook for receiving a selected pulse-like signal output by said stochastic codebook, said synthesis filter processing the set of filter coefficients and the selected pulse-like signal output by said stochastic codebook to generate the aperiodic component of the first synthetic audio signal.

27. An audio signal encoding device as defined in claim 25, wherein said signal encoding device includes an adder receiving the aperiodic component and the periodic component of the first synthetic audio signal to add the aperiodic component and the periodic component of the first synthetic audio signal for generating the first synthetic audio signal.

28. An audio signal encoding device as defined in claim 17, wherein said encoding device comprises a noise stochastic codebook comprising a plurality of entries, each entry being representative of noise-like signal.

29. An audio signal encoding device as defined in claim 28, wherein said signal encoding device includes a synthesis filter coupled to said noise stochastic codebook.

30. An audio signal encoding device as defined in claim 29, wherein said synthesis filter includes:

first synthesis filter input for receiving a set of filter coefficients;

a second synthesis filter input coupled to said stochastic codebook for receiving a selected noise-like signal output by said noise stochastic codebook, said synthesis filter processing the set of filter coefficients and the selected noise-like signal output by said noise stochastic codebook to generate the second synthetic audio signal.

31. An audio signal encoding device as defined in claim 17, wherein said processing unit includes a switch comprising:

a first input coupled to said voiced audio signal synthesis stage for receiving the first synthetic audio signal;

a second input coupled to said voiced audio signal synthesis stage for receiving the second synthetic audio signal;

an output for releasing either one of the first and second synthetic audio signals received at the first and second inputs of said switch.

32. An audio signal encoding device as defined in claim 31, wherein said processing unit includes a synthetic signal analyzer coupled to the output of said switch for processing the synthetic audio signal produced at the output of said switch.

33. An audio signal encoding device as defined in claim 32, wherein said synthetic signal analyzer includes a perceptual weighing filter analyzer coupled to the output of said switch for selectively conditioning the synthetic audio signal produced at the output of said switch.

34. A method for encoding an audio signal comprising the steps of:

receiving a sub-frame of an audio signal;

providing an adaptive codebook storing a plurality of prior knowledge entries;

producing a first synthetic audio signal approximating the sub-frame of the audio signal received on a basis of a first set of parameters, the first synthetic audio signal including a periodic component produced at least in part by multiplying by a certain gain value at least one prior knowledge entry in the adaptive codebook;

producing a second synthetic audio signal approximating the sub-frame of an audio signal received on a basis of a second set of parameters;

releasing a set of parameters allowing generation of a selected one of the first synthetic audio signal and the second synthetic audio signal.

35. A computer readable storage medium containing a program element implementing functional blocks of an audio signal encoding device, the functional blocks comprising:

an input for receiving a sub-frame of an audio signal;

a voiced audio signal synthesis stage coupled to said input capable of producing a first synthetic audio signal approximating the sub-frame of an audio signal received at said input on a basis of a first set of parameters, said voiced audio signal synthesis stage comprising:

a) an adaptive codebook in which are stored a plurality of prior knowledge entries;

b) a gain multiplier coupled to said adaptive codebook operative to generate on the basis of the prior knowledge entries in the adaptive codebook a periodic component of the first synthetic audio signal;

an unvoiced audio signal synthesis stage coupled to said input capable of producing a second synthetic audio signal approximating the sub-frame of an audio signal received at said input on a basis of a second set of parameters;

a processing unit coupled to said signal synthesis stages for outputting a set of parameters allowing generation of a selected one of the first synthetic audio signal and the second synthetic audio signal.

36. A computer readable storage medium containing a program element implementing functional blocks of an audio signal encoding device, the functional blocks comprising:

an input for receiving a sub-frame of an audio signal;

a voiced audio signal synthesis stage coupled to said input capable of producing a first synthetic audio signal approximating the sub-frame of an audio signal received at said input on a basis of a first set of parameters;

an unvoiced audio signal synthesis stage coupled to said input capable of producing a second synthetic audio signal approximating the sub-frame of an audio signal received at said input on a basis of a second set of parameters;

processing unit coupled to said signal synthesis stages for outputting a set of parameters allowing generation of a selected one of the first synthetic audio signal and the second synthetic audio signal, said processing unit comprising a switch having:

a) a first input coupled to said voiced audio signal synthesis stage for receiving the first synthetic audio signal;

b) a second input coupled to said unvoiced audio signal synthesis stage for receiving the second synthetic audio signal;

c) an output for releasing either one of the first synthetic audio signal and the second synthetic audio signal.

* * * * *